US007431778B2

(12) United States Patent
Somers et al.

(10) Patent No.: US 7,431,778 B2
(45) Date of Patent: Oct. 7, 2008

(54) CASE-HARDENING OF STAINLESS STEEL

(75) Inventors: Marcel A. J. Somers, Billund (DK); Thomas Christiansen, Frederiksberg (DK); Per Møller, Esrum (DK)

(73) Assignee: Danmarks Tekniske Universitet-Dtu, Lyngby (DK)

( * ) Notice: Subject to any disclaimer, the term of this patent is extended or adjusted under 35 U.S.C. 154(b) by 466 days.

(21) Appl. No.: 10/521,612

(22) PCT Filed: Jul. 15, 2003

(86) PCT No.: PCT/DK03/00497

§ 371 (c)(1),
(2), (4) Date: Jan. 14, 2005

(87) PCT Pub. No.: WO2004/007789

PCT Pub. Date: Jan. 22, 2004

(65) Prior Publication Data

US 2006/0090817 A1 May 4, 2006

(30) Foreign Application Priority Data

Jul. 16, 2002 (DK) ..... 2002 01108

(51) Int. Cl.
*C23C 8/22* (2006.01)
*C23C 8/26* (2006.01)
*C23C 8/32* (2006.01)

(52) U.S. Cl. ..... 148/218; 148/220; 148/230

(58) Field of Classification Search ..... 148/218, 148/220, 230

See application file for complete search history.

(56) References Cited

U.S. PATENT DOCUMENTS

| | | | | |
|---|---|---|---|---|
| 3,295,936 | A * | 1/1967 | Asano et al. | 428/628 |
| 3,901,771 | A * | 8/1975 | Froman et al. | 205/96 |
| 4,013,487 | A | 3/1977 | Ramqvist et al. | 146/16.5 |
| 5,417,776 | A * | 5/1995 | Yoshino et al. | 148/318 |

FOREIGN PATENT DOCUMENTS

| | | |
|---|---|---|
| DE | 294048 A | 9/1991 |
| EP | 0248431 | 10/1993 |
| JP | 59006367 | 1/1984 |
| WO | WO0050661 | 8/2000 |
| WO | WO0155470 | 8/2001 |

OTHER PUBLICATIONS

B. Larisch et al., "Plasma nitriding of stainless steels at low temperatures", Feb. 17, 2000, Institute of Material Engineering, Gustav-Zeuner-Str.5, 09596.*

(Continued)

*Primary Examiner*—John P. Sheehan
*Assistant Examiner*—Jessee R. Roe
(74) *Attorney, Agent, or Firm*—Cooper & Dunham LLP

(57) ABSTRACT

The invention relates to case-hardening of a stainless steel article by means of gas including carbon and/or nitrogen, whereby carbon and/or nitrogen atoms diffuse through the surface into the article. The method includes activating the surface of the article, applying a top layer on the activated surface to prevent repassivation. The top layer includes metal which is catalytic to the decomposition of the gas.

19 Claims, 2 Drawing Sheets

OTHER PUBLICATIONS

F. Lowenheim, Electroplating, 1978, McGraw-Hill Book Company, "Nickel Plating", pp. 211-224.*

Low temperature nitriding of iron, by Department of Interface Physics—Research Projects, p. 1-3 (Jul. 16, 2003).

V.D. Kuznetsov, "Stabilisation of the Processes of Nitriding and Carburization of High-Chromium Stainless Steels by Preliminary Nickel Plating Thereof", Issue 112, Trudy Kai, 1969.

* cited by examiner

CASE-HARDENING OF STAINLESS STEEL

TECHNICAL FIELD

The present disclosure relates to case hardening and, more particularly, to case hardening of stainless steel.

BACKGROUND ART

Thermo-chemical surface treatments of steel by means of carbon or nitrogen carrying gases are well-known processes, called case-hardening or carburization or nitriding. Nitro-carburization is a process in which a gas caring both carbon and nitrogen is used. These processes are traditionally applied to improve the hardness and wear resistance of iron and low alloyed steel articles. The steel article is exposed to a carbon and/or nitrogen carrying gas at an elevated temperature for a period of time, whereby the gas decomposes and carbon and/or nitrogen atoms diffuse through the steel surface into the steel material. The outermost material close to the surface is transformed into a layer with improved hardness, and the thickness of this layer depends on the treatment temperature and the treatment time.

Stainless steel has excellent corrosion properties, but is relatively soft and has poor wear resistance, especially against adhesive wear. Therefore, there is a need of improving the surface properties for stainless steel. Gas carburization, nitriding and nitro-carburizing of stainless steel involve some difficulties, as the passive layer, causing the good corrosion properties, acts as a barrier layer preventing carbon and/or nitrogen atoms from diffusing through the surface. Also the elevated temperatures of the treatments promote the formation of chromium carbides or chromium nitrides. The formation of chromium carbides and/or chromium nitrides reduces the free chromium content in the material whereby the corrosion properties are deteriorated.

Several methods of case-hardening stainless steel have been proposed by which these drawbacks are minimized or reduced.

It is known that a pre-treatment in a halogen-containing atmosphere provides an effective activation of the surface.

EP 0588458 discloses a method applying fluorine as an active component in a gas pre-treatment, where the passive layer of the stainless steel surface is transformed into a fluorine-containing surface layer, which is permeable for carbon and nitrogen atoms.

Plasma-assisted thermo-chemical treatment and ion implantation have also been proposed. In this case the passive layer of the stainless steel is removed by sputtering, which is an integrated part of the process.

EP 0248431 B1 discloses a method for electroplating an austenitic stainless steel article with iron prior to gas nitriding. The nitrogen atoms can diffuse through the iron layer and into the austenitic stainless steel. After gas nitriding, the iron layer is removed, and a hardened surface is obtained. In the only example of this patent, the process is carried out at 575° C. for 2 hours. At this temperature, chromium nitrides are formed, whereby the corrosion properties are deteriorated.

EP 1095170 discloses a carburization process in which an article of stainless steel is electroplated with an iron layer prior to carburization. A passive layer is avoided, and carburization can be carried out at a relatively low temperature without the formation of carbides.

NL 1003455 discloses a process in which an article of iron or a low alloyed steel is plated with a layer of e.g. nickel before gas nitriding. Nickel protects the iron from oxidation and serves as a catalytic surface for the decomposition of the $NH_3$ gas. The process can be carried out at temperatures below 400° C., and the purpose is to obtain a pore-free iron nitride layer.

DISCLOSURE OF INVENTION

Figure 1:
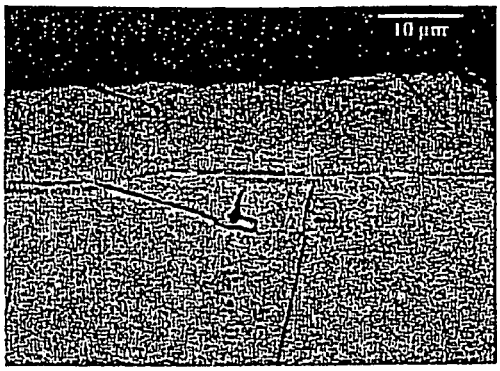
FIG. 1 illustrates a light optical microscopy (LOM) of an austenitic stainless steel article nitrided for 20 hours at 449° C.

The object of the disclosure is to provide a new and improved method for case-hardening stainless steel. A top layer includes metal which is catalytic to the decomposition of the gas carrying the carbon or/and nitrogen atoms and which is one or more of the metals Ni, Ru, Co or Pd. The metal layer protects the stainless steel surface from oxidation and acts as a catalytic surface for the decomposition of the gas. As a result, the process temperature can be kept below the temperature at which carbides and/or nitrides are formed, and the process can be finished within a reasonable period of time. After the thermo-chemical treatment, the catalytic metal layer can be removed to expose and repassivate the hardened stainless steel surface.

When carbon atoms, nitrogen atoms or both diffuse into stainless steel, the metastable S-phase is formed. S-phase is also called "expanded austenite" and has carbon and/or nitrogen in a solid solution at an upper stable temperature of about 450° C. when it is nitrogen-stabilized, and at about 550° C. when it is carbon-stabilized. Thus, the process according to the invention can be carried out at temperatures up to 450° C. or 550° C. to obtain S-phase.

Until now, S-phase in stainless steel has almost only been obtained by plasma-assisted or ion implantation-based processes. Tests have established that the formation of S-phase at the surface does not negatively change the corrosion resistance of stainless steel. For nitrogen-stabilized S-phase an improvement of corrosion resistance can be obtained.

When stainless steel is treated with the method according to the invention, the harness and wear resistance are improved considerably without the deterioration of the corrosion properties.

The ammonia synthesis, i.e. the production of $NH_3$ from $H_2$ and $N_2$, involves the use of a number of catalytic metals. Traditionally, the process is carried out at temperatures in the range 400° C.-700° C. at high pressures (>300 atm) in the presence of a catalyst material. Gaseous nitriding is in principle the reverse process of the ammonia synthesis, where ammonia is dissociated on a metal surface producing N available for diffusion into the material to be nitrided. The conventional nitriding process is carried out within the same temperature interval as the ammonia synthesis process but at normal pressures. The catalytic metals available in the ammonia synthesis process are also found to promote the low-temperature catalytic reaction (ammonia dissociation) of the nitriding process. Known catalysts from the ammonia synthesis process include Fe, Ni, Ru, Co, Pd among others.

According to an embodiment of the invention, the case-hardening is a nitriding process which is carried out with a nitrogen containing gas below a temperature at which nitrides are produced, preferably below approximately 450° C.

EP 0248431 B1 discloses a method where an austenitic stainless steel article is electroplated with iron before nitriding at 575° C. for 2 hours. As mentioned before, chromium nitrides are formed at this temperature. As disclosed on page 4, lines 13 to 18 of EP 0248431 B1, only the valve shaft of a valve is nitrided. The valve disk (Ventilteller) is protected from nitriding by an oxide layer in order not to reduce the corrosion resistance of the valve disk.

Until now, nitriding of stainless steel without the formation of chromium nitrides has only been obtained by the process disclosed in EP 0588458 in which the passive layer is transformed into a fluorine-containing layer. The disadvantages of the process of EP 0588458 are that the process is complicated to control, as the depassivation and the nitriding must be carried out at the same time and overexposure with fluorine may initiate pitting corrosion in stainless steel. A further disadvantage is the detrimental effect of fluorine on metallic parts in industrial furnaces.

According to another embodiment of the invention the case-hardening is a carburizing process with a carbon-containing gas, for example CO, and wherein the top layer is free of Fe. When a stainless steel article is provided with a top layer of iron, Fe-atoms will diffuse into the stainless steel article. After removal of the iron top layer, the surface-adjacent composition of stainless steel is diluted by incorporation of iron atoms which cause corrosion problems. Ni, Ru, Co or Pd are known as more noble metals than Fe and will not, even though atoms will diffuse into the stainless steel, deteriorate the corrosion properties of the stainless steel article. A further disadvantage of applying an iron layer is that iron easily corrodes, whereby carburizing must be carried out immediately after applying the iron layer. A thin layer of iron will corrode completely within a few days, whereby the stainless steel will be exposed to air and thus create a chromium oxide layer.

The carburizing is preferably carried out below a temperature, at which carbides are produced, preferably below approximately 550° C. When using a temperature close to but not exceeding 550° C. and e.g. CO as gas, a sufficient thickness of the S-phase layer can be obtained at the surface of an austenitic stainless article within a reasonable time period, e.g. six hours.

According to the invention the metal layer can be a nickel layer. Nickel is easy to apply and is excellent for the decomposition of carbon or nitrogen-containing gases. Nickel is furthermore easy to remove, e.g. by etching, after the thermochemical treatment.

Within the field of case-hardening, nickel is known to be non-permeable for nitrogen and carbon atoms. Therefore, nickel is sometimes used as a barrier layer at those locations where nitriding is not desired. However, as the tests, to be discussed later, show a stainless steel article provided with a thin top layer of nickel can be carburized or nitrided whereby a hard surface is obtained without the precipitation of carbides or nitrides.

According to a preferred embodiment the calculated maximum average thickness of the nickel layer does not exceed 300 nanometer, preferably 200 nanometer. A nickel layer of this thickness is sufficient to prevent oxidation and to allow carbon and/or nitrogen atoms to diffuse through the nickel layer into the stainless steel to form a satisfactory S-phase layer.

According to yet a further embodiment of the invention the nickel layer on the surface of the stainless steel article can be chemically or electrolytically plated, e.g. in a Wood's nickel bath.

According to a preferred embodiment the article is of austenitic stainless steel, e.g. AISI 304 or AISI 316.

According to an embodiment of the invention the catalytic metal layer is only applied to parts of the surface of the stainless steel article. This could be advantageous if the case-hardened steel article is to be welded together with other articles. As the case-hardened surface is not suitable for welding due to sensitization, the non-case-hardened parts can be used for that purpose.

EXAMPLES

The following examples with accompanying figures elucidate the invention.

In the following examples 1 to 6, disc-shaped stainless steel articles with a diameter of 2 cm and a thickness of 0.35 cm were all pre-treated in the following manner.

A depassivation was carried out in a solution of 100 ml 15% w/w hydrochloric acid +1 ml 35% hydrogen peroxide for 15 seconds.

A catalytic nickel layer was electrodeposited, thickness <200 nanometer (calculated average) in a Wood's nickel bath, which is an acidic halogenide-containing electrolyte.

The case-hardening was carried out in a furnace flushed with pure $NH_3$ or pure CO.

Example 1

Nitriding in Pure $NH_3$ Gas, Austenitic Stainless Steel AISI 304

An article of austenitic stainless steel AISI 304 was nitrided in pure $NH_3$ gas (maximum nitriding potential) for 17 hours and 30 minutes at 429° C. Heating to nitriding temperature was carried out in a hydrogen atmosphere ($H_2$), whereafter the supply of the hydrogen gas was switched off, and the nitriding gas was supplied. Cooling to room temperature was carried out in argon gas (Ar) in less than 10 minutes. The article was analysed by optical microscopy and electron probe micro-analysis (EPMA). The formed layer was nitrogen S-phase and bad a layer thickness not exceeding 9 μm. The maximum concentration of nitrogen in the S-phase was more than 20 atom %. The analysis disclosed that no nitrides had precipitated.

Example 2

Figure 2:
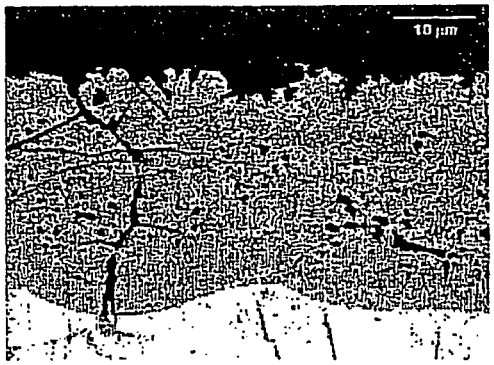
FIG. 2 illustrates a light optical microscopy (LOM) of an austenitic stainless steel article nitrided for 21 hours at 480° C.

Nitriding in Pure $NH_3$ Gas, Austenitic Stainless Steel AISI 316, FIGS. 1 and 2

An article of austenitic stainless AISI 316 was treated as described in Example 1, but at a temperature of 449° C. for 20 hours. The article was analysed by light optical microscopy (LOM), X-ray diffraction analysis (XRD) and micro-hardness measurements. The LOM results are shown in FIG. 1. The formed layer consisted of nitrogen S-phase and had a layer thickness of 12 μm. The micro-hardness was more than 1500 HV (load 100 g). The untreated stainless steel had a hardness between 200 and 300 HV. No nitrides had precipitated.

An austenitic steel article, heated in ammonia to 480° C. and kept for 21 hours at this temperature, showed the development of chromium nitride CrN (and ferrite) close to the surface as well as locally in the S-phase layer (the dark regions in FIG. 2). This result indicates that a high temperature of 480° C. should be avoided to obtain a monophase S-phase layer.

Example 3

Figure 3:
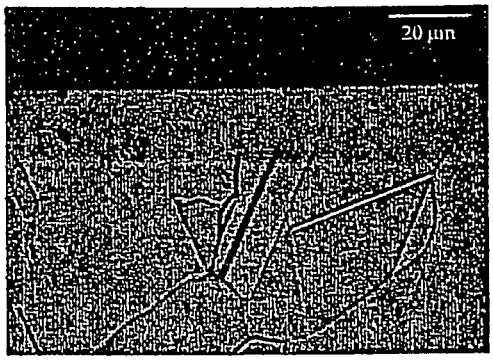
FIG. 3 illustrates a light optical microscopy (LOM) of an austenitic stainless steel article carburized for 6 hours at 507° C.

Carburizing in Pure CO Gas, Austenitic Stainless Steel AISI 316, FIG. 3

An article of austenitic stainless AISI 316 was carburized in pure CO gas for 6 hours at 507° C. to form the carbon S-phase. Heating was carried out in a hydrogen atmosphere ($H_2$), until the carburization temperature was obtained, and whereafter the supply of hydrogen was switched off and the CO gas was supplied. Cooling to room temperature was carried out in argon gas (Ar) in less than 10 minutes. The article was analysed by optical microscopy, X-ray diffraction analysis and micro-hardness measurements. The LOM results are shown in FIG. 3. The formed layer was carbon S-phase having a layer thickness of 20 μm (see FIG. 3). The micro-hardness of the surface was more than 1000 HV (load 100 g). No carbides had precipitated.

Example 4

Carburizing+Nitriding, Austenitic Stainless Steel AISI 316

An article of austenitic stainless steel AISI 316 was carburized as described in Example 3, but at the temperature of 500° C. for 4 hours. Thereafter, the article was nitrided as described in Example 1, but at a temperature of 440° C. for 18 hours and 30 minutes. Thus, two separate thermo-chemical processes were used, the one introducing carbon and the other nitrogen. The article was analysed by light optical microscopy analysis and micro-hardness measurements. The total layer thickness did not exceed 35 μm. The outermost layer was nitrogen S-phase, and the innermost layer was carbon S-phase. The micro-hardness was more than 1500 HV. Neither nitrides nor carbides had precipitated.

Example 5

Figure 4:
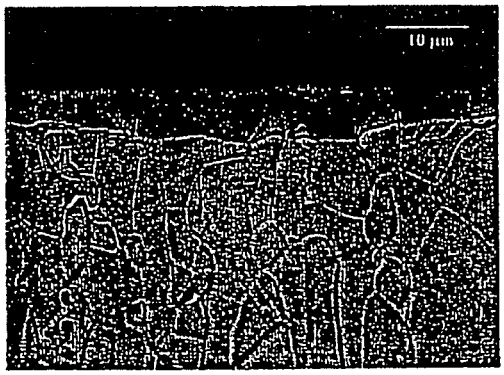
FIG. 4 illustrates a light optical microscopy (LOM) of a duplex stainless steel article nitrided for 23 hours and 20 minutes at 400° C.
Figure 5:
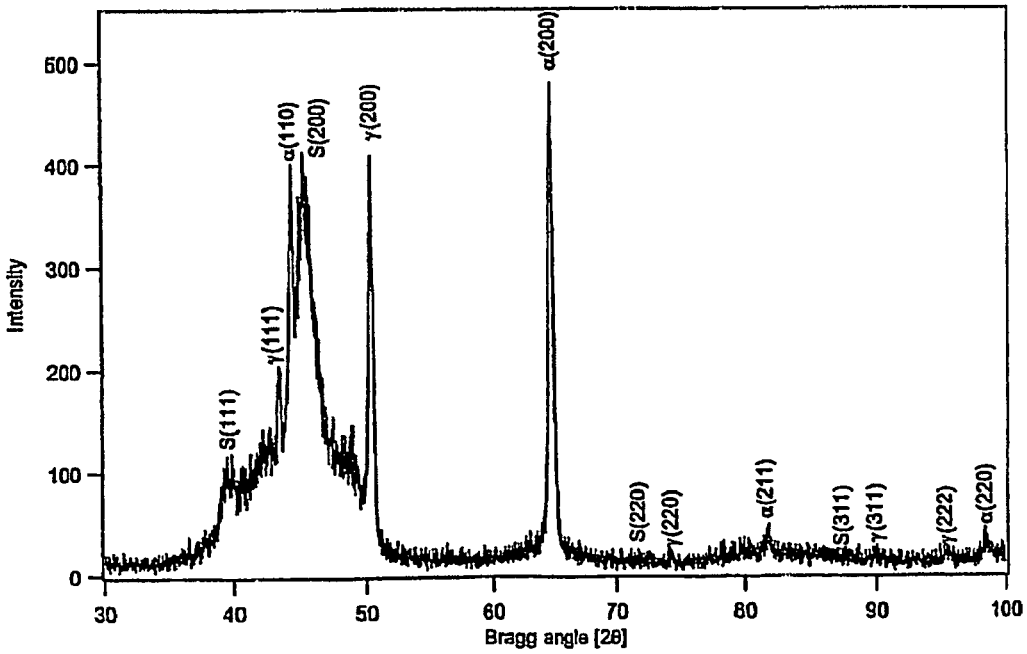
FIG. 5 illustrates an x-ray diffraction analysis (XRD) of a duplex stainless steel nitrided for 23 hours and 20 minutes at 400° C.

Nitriding in Pure $NH_3$ Gas, Duplex Stainless Steel AISI 329, FIGS. 4 and 5

Samples were nitrided for 23 hours and 20 minutes at 400° C. The metallurgical investigations of the nitrided articles involved X-ray diffraction analysis (XRD) and light optical microscopy analysis (LOM). The stainless steel AISI 329 is a duplex steel consisting of ferrite and austenite. After nitriding at 400° C., ferrite is transformed into austenite (and S-phase) in the case-hardened zone. A LOM image of the article after treatment at 400° C. is shown in FIG. 4; the corresponding XRD pattern in given in FIG. 5. It is obvious that the S-phase has developed along the surface of the duplex steel.

Example 6

Figure 6:
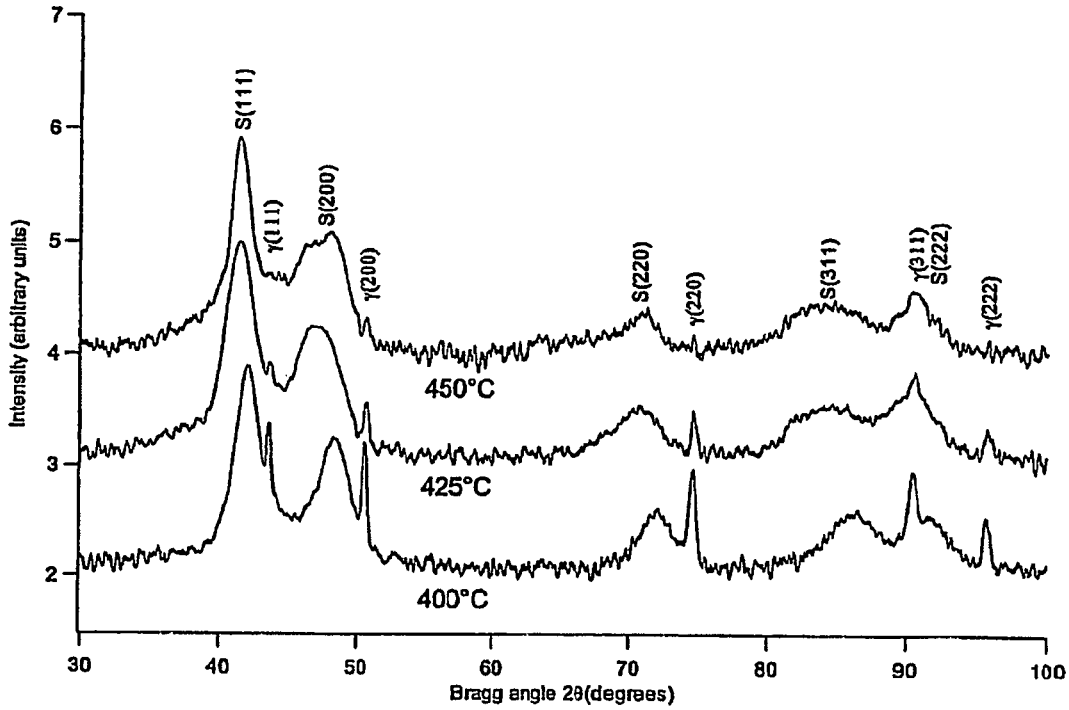
FIG. 6 illustrates an x-ray diffraction analysis (XRD) of an austenitic stainless steel nitrided for 23 hours and 20 minutes at 400° C., 425° C., and 450° C.

Nitriding in Pure $NH_3$ Gas, Austenitic Stainless Steel AISI 316, FIG. 6

The AISI 316 steel article was treated at 400° C., 425° C. and 450° C. for 23 hours and 20 minutes. The diffraction pattern shown in FIG. 6 clearly shows that the S-phase is the only phase formed during the nitriding treatment.

The case-hardening temperatures of the examples 1 to 6 above are in the range between 400° C. and 507° C. However, it is likely that S-phase also can be obtained at lower temperatures, e.g. 300° C. or 350° C. at high nitriding/carburizing potentials within a reasonable time range.

Preliminary experiments have shown that S-phase also can be obtained with AISI 420, which is a martensitic stainless steel, and AISI 17-4 PH, which is a martensitic precipitation hardening steel.

Example 7

Figure 7:
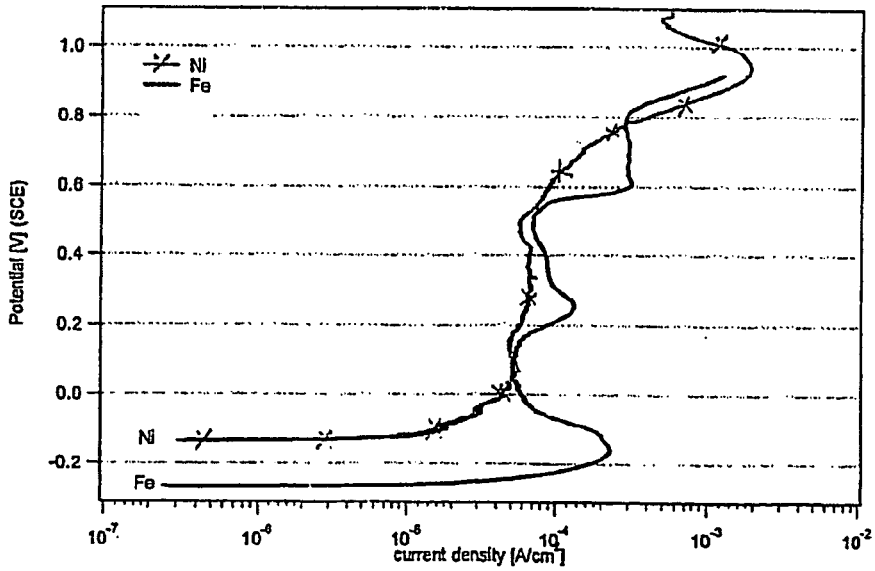
FIG. 7 illustrates cyclic polarization curves for nitrided stainless steel samples having nickel and iron electrochemically deposited layers.

Comparison of Corrosion Properties of Nitrided Stainless Steel Samples Provided with a Top Layer of Fe and Ni, Respectively, FIG. 7

AISI 316 specimens with a machined surface were examined. The samples were chemically activated in a solution of 50 ml HCL+50 ml water+1 ml $H_2O_2$. Fe and Ni were deposited electrochemically in order to compare the effect on the corrosion properties after nitriding. The deposition was performed for 40 sec. at a current density of 6.5 A/dm$^2$ for both Fe and Ni. The samples were gas nitrided in 100% $NH_3$ for 16 hours at 449° C. After the nitriding, the surface layers were removed chemically (diluted $HNO_3$). The specimens were weighed before and after the nitriding treatment. Both samples gained 3.8 mg in weight due to uptake of nitrogen, irrespective of the electrodeposited layer at the surface (Ni or Fe). This indicates that the dissociation reaction at the surface of the electrodeposited layer is not rate determining.

Cyclic polarisation curves (FIG. 7) were recorded in a three electrode cell, using a PGP 201 Radiometer potentiostat interfaced with a computer. The test solution was 5 wt % NaCl. The counterelectrode was a platinum sheet. All the potentials reported are relative to the potential of a saturated calomel electrode (SCE). The scanning rate for the polarisation curves was 10 mV/min.

The scans were started below the free corrosion potential ($E_{corr}$), i.e. at a cathodic current. Anodic polarisation scans were recorded up to a maximum potential of +1100 mV or up to a maximum current density of 1.25 mA/cm$^2$ where the polarisation was stopped.

The anodic polarization curves depict the measured current density as a function of the applied potential. The free corrosion potential is −266 mV and −134 mV for Fe and Ni, respectively. Consequently, a more noble material is obtained after nitriding when using Ni as compared to Fe.

The passive current for the Fe sample is higher than for the Ni sample. Furthermore, the Fe curve exhibits what appears to be a pitting-repassivation behaviour, i.e. pitting is initiated and stopped. Pitting is seemingly more easily initiated on the Fe-sample. This is caused by the contamination of the stainless steel surface either by diffusion of Fe atoms into the steel matrix or by residues of Fe (nitride) at the surface. However, possible Fe-containing residues could also explain the step-like appearance of the polarisation curve due to the corrosion of these. In any case, an inferior corrosion resistance is observed for the Fe-sample.

The polarization curves show that the Fe-sample is inferior to the Ni-sample with regard to corrosion. Using Fe will most certainly contaminate the stainless steel at the nitriding temperature used. This effect will particularly be dominant during carburizing, due to the higher temperature involved here.

The experiments have established that the nitriding treatments performed at a small-scale laboratory furnace can be readily transferred to an industrial furnace.

In the examples 1 to 6, the catalytic layer of nickel was electrodeposited from a Wood's nickel bath. Alternatively, electroless nickel plating, e.g. contact plating might be applied. Palladium and ruthenium could be plated by ion exchange plating.

The method according to the invention is suitable for nitriding or carburizing "in situ" of a plant. Stainless steel pipes and tanks could be nickel-plated prior to installation. After installation, parts of the system, which are exposed to wear, could be heated and flushed with $NH_3$ or other nitrogen or carbon-containing gases.

A very suitable method for applying a layer of electrolytic nickel on parts of a surface is brush-plating.

It is the idea of the present invention to apply a surface layer on the stainless steel chosen from the selection of metals used in the ammonia synthesis process.

The same idea is followed with respect to carburizing, where the same catalytic metals are applicable also.

The material applied for the surface layer should include the well known materials from the ammonia synthesis process either as pure metals (single layer), as alloys, as a metal layer doped with other metals and as multi-layers.

The invention claimed is:

1. A method of case-hardening a stainless article by use of gas including carbon and/or nitrogen, i.e. gas carburizing and/or gas nitriding, whereby carbon and/or nitrogen atoms are diffused through a surface of the article, said method comprising:

activating the surface of the article;

applying a top layer on the activated surface to prevent repassivation, the top layer including one or more of the metals Ni, Ru, Co or Pd, which are catalytic to decomposition of the gas; and subsequently carrying out the case hardening below a temperature at which carbides and/or nitrides are produced.

2. A method according to claim 1, wherein the article is of austenitic stainless steel.

3. A method according to claim 1, wherein the catalytic metal layer is only applied to part of the surface of the stainless steel article.

4. A method according to claim 1, wherein the top layer is a nickel layer.

5. A method according to claim 4, wherein the maximum average thickness of the nickel layers is 300 nanometers.

6. A method according to claim 5, wherein the thickness is 200 nanometers.

7. A method according to claim 5, wherein the nickel layer is applied by a chemical or electrolytical plating.

8. A method according to claim 7, wherein the nickel layer is applied by a Wood's nickel bath.

9. A method according to claim 1, wherein the case-hardening is a nitriding process which is carried out with a nitrogen-containing gas below a temperature at which nitrides are produced.

10. A method according to claim 9, wherein the article is of austenitic stainless steel.

11. A method according to claim 9, wherein the top layer is a nickel layer.

12. A method according to claim 9, wherein the catalytic metal layer is only applied to part of the surface of the stainless steel article.

13. A method according to claim 9, wherein the temperature is below 450C.

14. A method according to claim 1, wherein the case-hardening is carburizing with a carbon-containing gas.

15. A method according to claim 14, wherein the top layer is a nickel layer.

16. A method according to claim 14, wherein the gas is CO.

17. A method according to claim 14, wherein carburizing is carried out below a temperature at which carbides are produced.

18. A method according to claim 17, wherein the temperature is below 550C.

19. A method according to claim 17, wherein the temperature is below 510C.

* * * * *